United States Patent [19]

Blanchard et al.

[11] Patent Number: 4,556,158

[45] Date of Patent: Dec. 3, 1985

[54] PARALLEL BAR HANGER WITH COMPRESSION HINGE

[75] Inventors: Russell O. Blanchard, Zeeland; John H. Batts, East Grand Rapids, both of Mich.

[73] Assignee: John Thomas Batts, Inc., Zeeland, Mich.

[21] Appl. No.: 709,333

[22] Filed: Mar. 7, 1985

[51] Int. Cl.[4] ..... A41D 27/22

[52] U.S. Cl. ..... 223/88; 223/96

[58] Field of Search ..... 2/85, 87, 88, 92, 93, 2/94, 95, 96; D6/315–328, 512, 513, 514

[56] References Cited

U.S. PATENT DOCUMENTS

| | | | |
|---|---|---|---|
| D. 241,397 | 9/1976 | Peel | D6/318 |
| 364,346 | 6/1887 | Hauck . | |
| 835,481 | 11/1906 | Taylor . | |
| 1,008,327 | 11/1911 | Hamilton . | |
| 1,112,775 | 10/1914 | Crutcher . | |
| 2,678,149 | 5/1954 | Walther | D6/318 |
| 3,603,491 | 9/1971 | Weight | 223/96 |
| 3,680,746 | 8/1972 | Seckelmann | 223/88 |
| 3,730,406 | 5/1973 | Sullivan . | |
| 4,115,940 | 9/1978 | Phillips | 223/85 |
| 4,177,908 | 12/1979 | Batts et al. . | |

FOREIGN PATENT DOCUMENTS

| | | | |
|---|---|---|---|
| 2055128 | 5/1972 | Fed. Rep. of Germany | 223/96 |
| 2338678 | 8/1977 | France | 223/85 |

*Primary Examiner*—Louis K. Rimrodt
*Assistant Examiner*—Joseph S. Machuga
*Attorney, Agent, or Firm*—Price, Heneveld, Huizenga & Cooper

[57] ABSTRACT

A one-piece molded plastic garment hanger has upper and lower bars connected at one end by a hinge. The hanger has a support hook generally centered between the ends of the hanger and integral with the lower bar. The hinge is designed with inner and outer spaced spring members separated by a gap with the inner spring member serving as the pivot and the outer one having a rigid web in its apex serving as a stiffener. The entire hinge in open position being inclined downwardly at an acute angle to the axis of the lower bar. When the hanger is closed and the bars generally parallel, the hinge is pivoted upwardly into substantial alignment with the lower bar axis.

15 Claims, 12 Drawing Figures

Fig. 7.
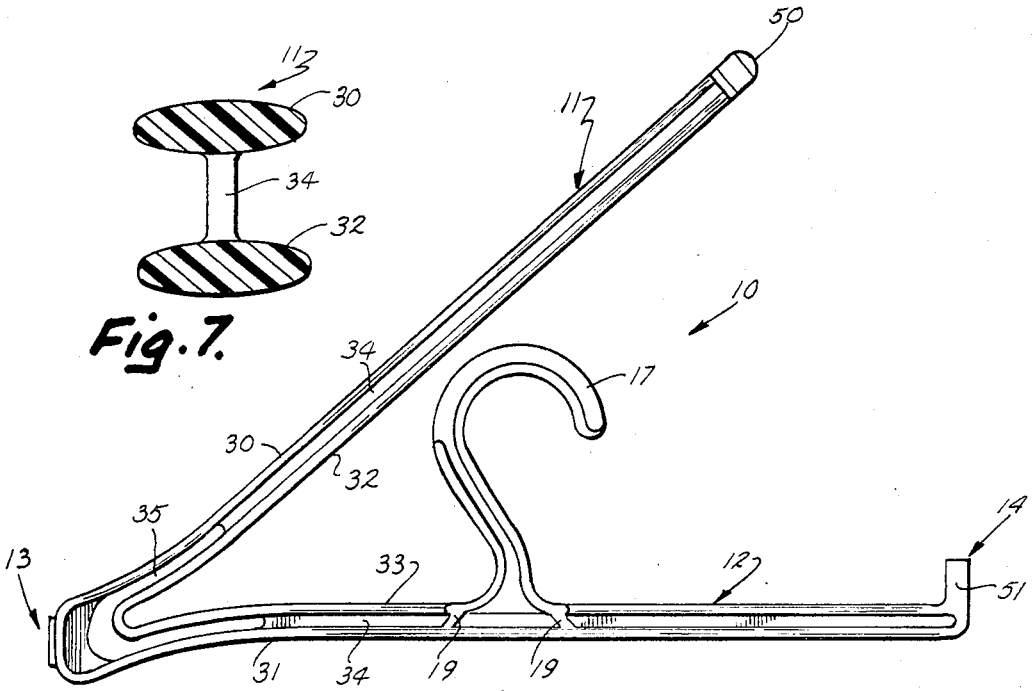
Fig. 1.
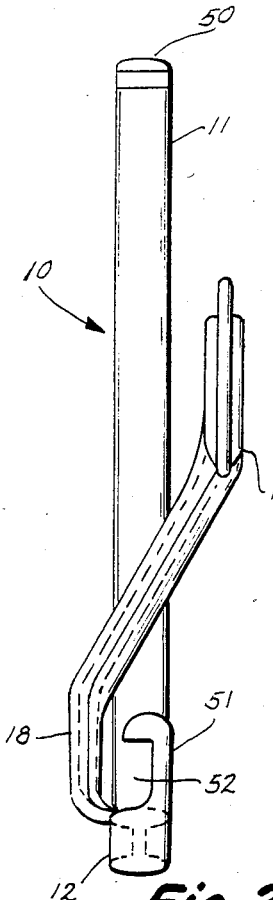
Fig. 2.
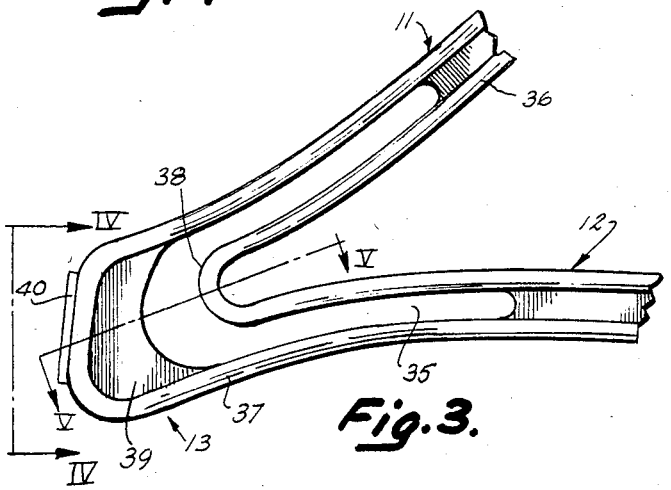
Fig. 3.
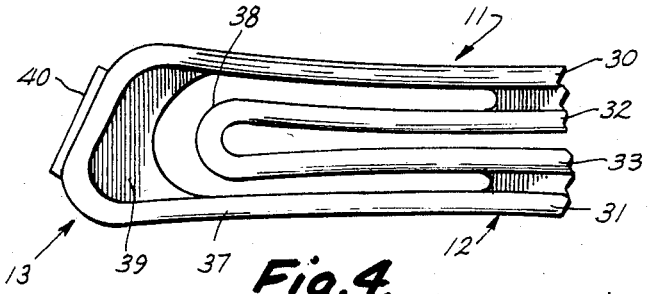
Fig. 4.

PARALLEL BAR HANGER WITH COMPRESSION HINGE

FIELD OF THE INVENTION

This invention relates to molded plastic hangers for garments and, more particularly, to such hangers specifically designed for slacks, pants and the like.

BACKGROUND OF THE INVENTION

It has become conventional practice to utilize garment hangers not only for display of garments at the retail level but also to utilize the garments as a means of transport such as from the factory to the wholesaler or the retailer. In some cases the garment is placed on a hanger and will remain with that hanger and will ultimately be given to the final purchaser. In order to be satisfactory for this purpose, the hanger should have certain important functional characteristics. These characteristics include ease of placing the garment on the hanger and ease of removal of the garment from the hanger. Particularly is this latter characteristic desirable at the retail level where the garment may be removed from the hanger several times for purpose of display or determining the fit. It is also important that the hanger be capable of positively holding the garment during transport. In doing so, it must hold the garment against sliding off the hanger and it must also prevent the garment from sliding toward one end of the hanger and becoming bunched at that end which will result in creasing or otherwise marking the garment. It is particularly important from the point of view of the retailer that whatever means the hanger provides to grip the garment against inadvertent release or sliding to one end, not so tightly clamp or hold the garment that it will crease it because a creased garment has to be pressed before the customer will take it and this is an expensive operation. It is also important that the hanger be inexpensive and be so simple and quick to operate that its use is not a labor intensive operation. In the past, hangers have been developed which have a pair of bars, one of which can be separated or at least spread apart from the other to permit a garment to be draped over it and then the bars brought together to clamp or hold the garment. The bars or rods of this type of hanger are hinged together at one end. For this purpose a number of hinge constructions have been developed including a hinge which is molded integral with both of the bars. The hinges have proved to be a source of difficulty from several standpoints. Among these is that if they are so made that they are not readily subject to fatigue, they have insufficient resilience to be readily usable. If they are so designed that they can withstand frequent usage without fatiguing, they are too stiff to be readily operable. This invention provides a solution to such problems as well as others.

BRIEF DESCRIPTION OF THE INVENTION

The invention provides a one-piece integral molded plastic hanger having an upper bar and a lower bar integral with each other at one end by means of a hinge. The hinge is so shaped it has a downwardly inclined portion when the hanger is open with the upper bar pivoted into an upwardly inclined position. However, when the bar is pivoted to the closed position parallel to the lower bar, the hinge itself shifts into a position which is substantially parallel with the bars. In so doing, the hinge provides the required resistance or stiffness to the respositioning of the upper bar and is able to accomplish this without distortion of the plastic forming the hinge that will result in breakage and fatigue. The construction of the hinge does not add significantly to the cost of the hanger but, at the same time, it does improve the operating characteristics of the hanger when the upper bar has to be manipulated.

BRIEF DESCRIPTION OF THE DRAWINGS

FIG. 1 is a front elevation view of the hanger in its as-molded condition;

FIG. 2 is an end view of the hanger as viewed from the latch end;

FIG. 3 is an enlarged, fragmentary front elevation view of the hinge for the hanger in open position;

FIG. 4 is a view similar to FIG. 3 but showing the hinge in the closed position;

FIG. 7 is an enlarged sectional view taken along the plane VII—VII of FIG. 3;

DESCRIPTION OF THE PREFERRED EMBODIMENT

Figure 6:
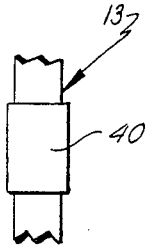
FIG. 6 is a fragmentary end view taken along the plane VI—VI of FIG. 3.

Referring to the drawings, the numeral 10 refers to a hanger having an upper bar 11 and a lower bar 12 integrally joined at one end by a hinge 13. The other ends of the bars, when the hanger is closed, are connected by a latch 14 having a keeper 51 and a strike 16. Intermediate the ends of the lower bar 12, preferably centered between its ends, is a hook 17. As will be seen from FIG. 2, the lower portion of the hook is offset at 18 whereby the upper bar can be pressed around the hook and into a position where it is parallel to and vertically aligned with the lower bar 12. The upper portion of the hook is offset in the opposite direction so that it will be centered above the center of the load applied to the hanger when the hanger is occupied by a garment draped over the upper bar. The upper bar, the lower bar, the latch assembly 14, the hook 17 and the hinge 13 are all molded as a single integral structure thereby eliminating all assembly operations and thus materially reducing the labor content of the manufacturing cost of the hanger. The position of the upper bar 11 as the hanger is removed from the mold is that illustrated in FIGS. 1 and 2. This creates a bias in the hinge structure which will return the upper bar to this position whenever it is released to assume its normal position. The upper and lower bars are each of I-beam cross section giving them rigidity with minimal use of material. At the base of the hook, the lower bar or beam is reinforced by struts 19 to distribute the load between the upper and lower flanges of the lower bar.

The hinge 13 is formed by shaping the upper flange 30 of the upper bar 11 into a somewhat V-shaped loop so that it becomes the lower flange 31 of the lower bar 12 and, in a similar manner, forming the lower flange 32 of the upper bar 11 so that it becomes the upper flange 33 of the lower bar. In the area of the hinge, the central web 34 of the I-beam construction is eliminated leaving an elongated generally V-shaped aperture 35. This construction provides the hinge with inner and outer spring members 36 and 37, respectively. The inner spring member 36 forms a rounded apex 38 which becomes the pivot about which the hinge rotates when the hanger is opened and closed. The outer spring 37 extends substantially beyond the apex of the inner spring and within the loop formed by the outer spring a web similar to web 39 occupies the outer portion of the loop. The inner wall of the web 39 is curved on an arc that is generally concentric with the rounded apex of the inner spring. When the bar 11 is in its released position as illustrated in FIG. 1, the spacing between the inner edge of the web 39 and the adjacent apex 38 of the inner spring 36 is somewhat wider than the remainder of the aperture 35. However, when the hanger is closed and the bar 11 moved to a position parallel with the lower bar 12, this portion of the aperture narrows so that there is general uniformity of width throughout the length of the aperture. The web 39 provides resistance to the closing of the hinge and thus is a stiffener giving the hinge a substantial spring action when the hanger is opened and closed.

Because of this construction, when the hanger is in released position as illustrated in FIG. 1, the hinge is inclined downwardly at an acute angle from the plane of the lower bar 12. In a preferred construction, this downward inclination is approximately 40 degrees. However, when the upper bar 11 is pivoted to the closed position generally parallel to the lower bar 12, the entire hinge structure pivots upwardly until it is almost aligned with the bars. This results from the fact that as the upper bar is moved to the closed position, the apex 38 of the inner spring 36 shifts a very short distance outwardly and pivots upwardly. At the same time, due to the presence of the stiffening web 39, the outer spring is forced to rotate about the apex of the inner spring and rotates upwardly a substantially greater distance and substantially eliminates the curvature which is built into both the inner and outer springs. In so doing, the outer spring is placed under a substantial tension load because its outer apex is unable to deflect. The rigidity of the web transfers the deformation required to close the hinge to that portion of the outer spring which extends from the inner end of the stiffening web 39 to the inner end of the aperture 35 in both the upper and lower bars.

It is also significant to the function of the hinge 13 that the aperture 35 extends a substantial distance along both the upper and lower bars and between the ends of the hinge and the ends of the aperture 35, the upper and lower bars are curved away from each other to form a V, the sides of which are curved outwardly. This is important in providing a zone where the inner spring member acts in compression and the outer spring member acts in tension when the hanger is opened and closed.

At the apex of the outer spring, the outer surface is flattened to form a panel 40. The panel 40 is non-functional so far as the spring is concerned but does serve as a surface on which indicia can be mounted to provide information concerning what is on the hanger such as size, etc. It will be noted from FIG. 3 that in order to provide the panel 40 the outer end of the apex of the outer spring is flattened and the lower portion of the spring adjacent the apex is curved more sharply in a downwardly direction. These arrangements have been embodied in the spring structure so that the panel 40 will remain in a highly visible position when the spring is closed as is indicated in FIG. 4. However, if the panel is eliminated, the outer spring could be redesigned with a smoothly rounded apex similar to the apex of the inner spring without in any way affecting the function of the spring.

Figure 12:
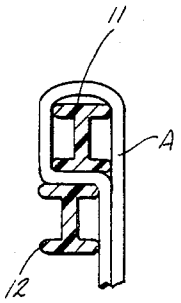
FIG. 12 is a sectional view taken along the plane XII—XII of FIG. 11.
Figure 8:
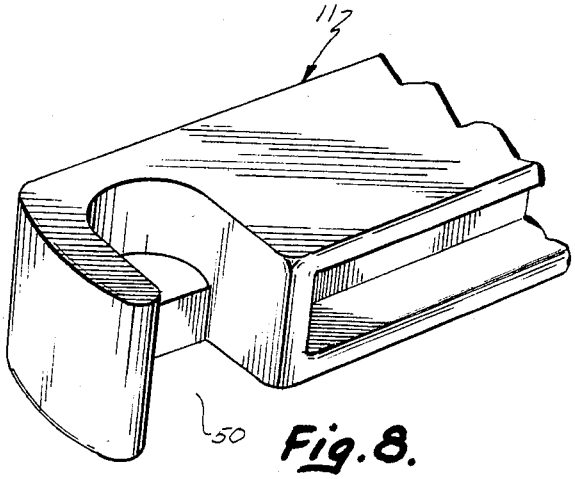
FIG. 8 is a fragmentary oblique view of the latch end of the upper bar.
Figure 10:
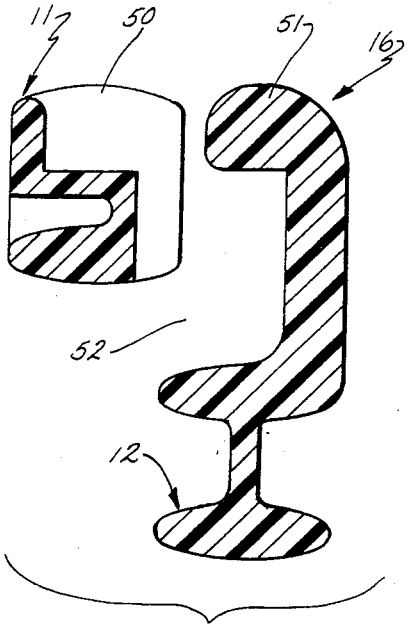
FIG. 10 is an enlarged, exploded sectional view of the latch.
Figure 5:
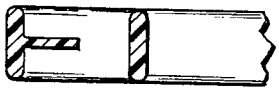
FIG. 5 is a fragmentary sectional view taken along the plane V—V of FIG. 3.
Figure 9:
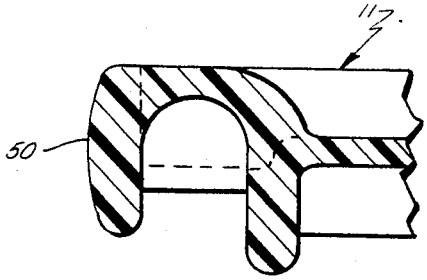
FIG. 9 is an enlarged sectional view taken along the plane IX—IX of FIG. 8.
Figure 11:
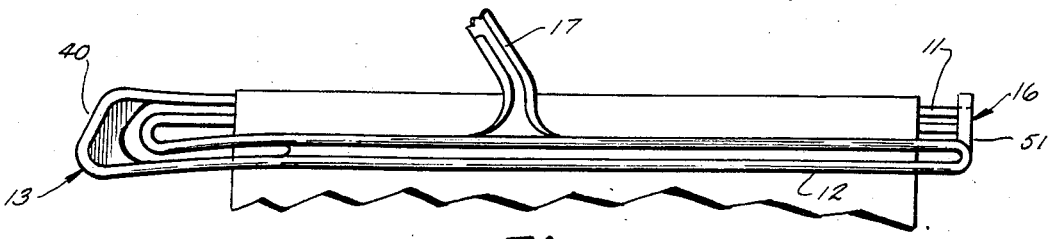
FIG. 11 is a fragmentary front view of the hanger closed and with a garment draped over the upper bar.

To utilize the hanger, the operator can grasp the hanger by the lower bar or the hook in one hand and tilt it until the upper bar 11 is substantially horizontal. At that point the operator with the other hand can drape a garment such as pants or slacks over the bar 11 and, by a combination of closing the bar forcefully and the weight of the garment, the upper bar 11 can be pivoted downwardly while being pivoted laterally to pass around the hook 17 until the bars are parallel. In so doing, the inner leg of the garment is forced to pass around the back side of the upper bar, under the upper bar and between it and the lower bar and then, with the other leg, hang downwardly against the front face of the lower bar as illustrated in FIG. 12. At this point the strike 50 of the upper bar is passed over the top of the keeper 51 of the lower bar until the strike can be seated within the pocket 52 of the lower bar (FIG. 10). By virtue of the fact that a portion of the garment is pressed between the upper and lower bars as illustrated in FIG. 12, the garment provides a bias pulling the strike 50 of the upper bar into the pocket 52 of the latch 51 on the lower bar. At the same time, the garment also reinforces the upward pivotal bias of the upper bar so that the strike hooks upwardly as well as inwardly into the keeper 51. To remove the garment from the hanger, it is only necessary to disengage the latch and allow the upper bar to swing slightly laterally so the garment can be removed endwise from the upper bar. The pressure generated by the garment, as illustrated in FIG. 11, while adequate to hold the latch in positive engagement, even during handling and transport of the hanger and garment, need not be of a magnitude that will crease or otherwise leave any mark on the garment when it is removed. This is important in maintaining the garment in acceptable condition for prospective customers. At the same time, the grip the hanger exerts on the garment is sufficiently positive that the garment will remain on the hanger even though subjected to vibration, impact and other forces which are adequate with many hanger constructions to cause the garment to be inadvertently released. At the same time, the hanger's construction is such that it may be repeatedly used without fatigue at the hinge. In this connection it must be kept in mind that not only does the hinge have to withstand vertical movement as it is opened and closed but it also must be able to sustain repeated lateral twisting in order to permit the upper bar to pass around the upper portion of the hook 17. This problem is accentuated by the fact that the upper portion of the hook must be offset toward the front of the hanger so that it will be basically centered with respect to the hanger as loaded. The center of loading of the hanger is forced to the front of the hanger by the fact that the major portion of the garment is offset to the front side of the bars as they are closed as is indicated in FIG. 11. The fact that the aperture 35 is relatively long and the outer portion of the outer spring is reinforced by the web 39 and the inner portions of both the inner and outer springs are relatively long, permits this lateral deflection or twisting to occur over a sufficient length of material that no portion of the material is strained to the point of fatiguing. Thus, the hanger, while inexpensive and compact, is effective, not only for transportation and display purposes, but also may be repeatedly reused because it has an exceptionally long life.

Having described a preferred embodiment of the invention, it will be understood that various modifications of the invention can be made without departing from the principles of the invention. Such modifications are to be considered as included in the hereinafter appended claims unless these claims, by their language, expressly state otherwise.

We claim:

1. A one-piece molded plastic garment hanger having a body including upper and lower bars each of I-beam cross section and pivotally connected at one end, a support hook connected to the lower bar substantially midway between the ends of the bars, latch means at the other end of the bars for detachably securing the bars together in substantially parallel and vertically aligned relationship, the improvement in said hanger comprising: a hinge forming said connection between said bars at said one end, the parallel flanges of said bars at said hinge being spaced and detached forming inner and outer spring members each including a loop extending from the upper to the lower bar and the web connection between the flanges of the I-beam bars being eliminated throughout the length of the hinge, the outer spring member extending outwardly substantially beyond the end of the inner spring member and having a web centered between the edges of the outer spring and occupying a portion of the loop of said outer spring for biasing the upper bar into an upwardly inclined position with respect to the lower bar at an acute angle and stiffening said outer spring against movement of the upper bar toward the lower bar.

2. The garment hanger described in claim 1 wherein said hinge when the hanger is open and the upper bar is free to assume the angle to which it has been biased being inclined downwardly at an acute angle toward the apex of the hinge and being aligned with the bars when the bars are shifted to parallel position.

3. The garment hanger described in claim 2 wherein the flanges of the lower portion of the hinge are curved downwardly at a progressively increasing angle toward the hinge apex and the flanges of the upper portion of the hinge curved upwardly at a progressively increasing angle away from the hinge apex.

4. The garment hanger described in claim 3 wherein said bars, except at said curved portions forming part of said hinge, are straight, an aperture formed between the top and bottom flanges of said beams at said hinge and extending from the juncture of the curved and straight portions of said upper bar to the juncture of the curved and straight portions of said lower bar.

5. The garment hanger described in claim 2 wherein the angular relationship between the centerline of the hinge portion and the lower bar when the upper bar is in its released open position is approximately 20 degrees.

6. The garment hanger described in claim 1 wherein the outer end face of the outer spring has a flat surface inclined downwardly and outwardly when the bars are positioned both angularly and parallel to each other.

7. The garment hanger described in claim 1 wherein the angular relationship between the bars when the upper bar is in its released open position is approximately 40 degrees.

8. A one-piece molded plastic garment hanger having a body including upper and lowr bars pivotally connected at one end, a support hook connected to the lower bar substantially midway between the ends of the bars, latch means at the other ends of the bars for detachably securing the bars together in substantially parallel and vertically aligned relationship, the improvement in said hanger comprising: a hinge forming said connection between said bars, said hinge having spaced inner and outer spring members each having upper and lower legs and each forming a loop extending from the upper to the lower bar, the outer spring member extending substantially beyond the end of the inner spring member and having a web integral with the upper and lower legs and occupying a portion of the apex of the loop of the outer spring for biasing the upper bar into an upwardly inclined position with respect to the lower bar at an acute angle and stiffening said outer spring against movement of the upper bar toward the lower bar.

9. The garment hanger described in claim 8 wherein the inner spring is of substantially uniform cross section throughout its length and serves as the axis about which the upper bar pivots between open and closed positions.

10. A one-piece molded plastic garment hanger having a body including upper and lower bars pivotally connected at one end, a support hook connected to the lower bar substantially midway between the ends of the bars, latch means for detachably securing the bars together in substantially parallel and vertically aligned relationship, the improvement in said hanger comprising: a hinge forming the connection between said bars, said hinge having spaced generally parallel inner and outer spring members each forming a loop, said loops being positioned, one inside the other and detached from each other for independent movement, the outer spring member extending substantially beyond the end of the inner spring member, stiffening means secured to the outer spring and occupying a portion of the interior of the loop of said spring for biasing the upper bar into an upwardly inclined position with respect to the lower bar at an acute angle and stiffening said outer spring against movement of the upper bar toward the lower bar and causing said upper bar to pivot about the inner spring.

11. The garment hanger described in claim 10 wherein said upper and lower bars are of I-beam cross section and an aperture is formed in the web of the bars extending the length of said hinge from the upper bar to the lower bar.

12. The garment hanger described in claim 11 wherein said hinge, when the upper bar is released and the hanger is open, is inclined downwardly to the plane of the lower bar.

13. The garment hanger described in claim 12 wherein said aperture is co-extensive in length with the inclined portion of said hinge.

14. The garment hanger described in claim 13 wherein when said hanger is closed and said bars are substantially parallel, said hinge is pivoted to a position substantially aligned with said upper and lower bars.

15. The garment hanger described in claim 14 wherein latch means is provided at the ends of said bars remote from said hinge for locking said bars in closed substantially parallel position.

* * * * *